United States Patent [19]

Makielski

[11] Patent Number: 5,062,375

[45] Date of Patent: Nov. 5, 1991

[54] BOAT ANCHOR LINE CONTROL

[76] Inventor: James A. Makielski, 125 W. Marion, Apt. 222, South Bend, Ind. 46601

[21] Appl. No.: 680,839

[22] Filed: Apr. 5, 1991

[51] Int. Cl.[5] ..... B63B 21/22

[52] U.S. Cl. ..... 114/210; 114/293

[58] Field of Search ..... 114/210, 293, 294, 253, 114/254; 254/366, 264, 389; 24/599

[56] References Cited

U.S. PATENT DOCUMENTS

| | | | |
|---|---|---|---|
| 2,938,491 | 5/1960 | Scanlin | 114/210 |
| 3,626,888 | 12/1971 | Cameron | 114/210 |
| 4,057,025 | 11/1977 | Piotrowski | 114/210 |
| 4,290,380 | 9/1981 | Bolen | 114/210 |
| 4,362,119 | 12/1982 | Thimander | 114/210 |
| 4,616,589 | 10/1986 | Adams | 114/210 |
| 4,683,834 | 8/1987 | Fujimoto et al. . | |
| 4,913,076 | 4/1990 | Norton | 114/210 |

*Primary Examiner*—Jesus D. Sotelo
*Assistant Examiner*—Stephen P. Avila

[57] ABSTRACT

A mechanism for controlling the extension of a boat anchor line from a boat, to thus anchor a boat in waters of different depths, or to let the boat drift downstream different distances from the submerged anchor. The mechanism includes a line-guidance pulley and a line-gripper device having a spring means for biasing the device to a condition wherein the line is held motionless against travel into or out of the boat. A c-clamp is used to detachably mount the mechanism on the side wall of a small boat.

9 Claims, 1 Drawing Sheet

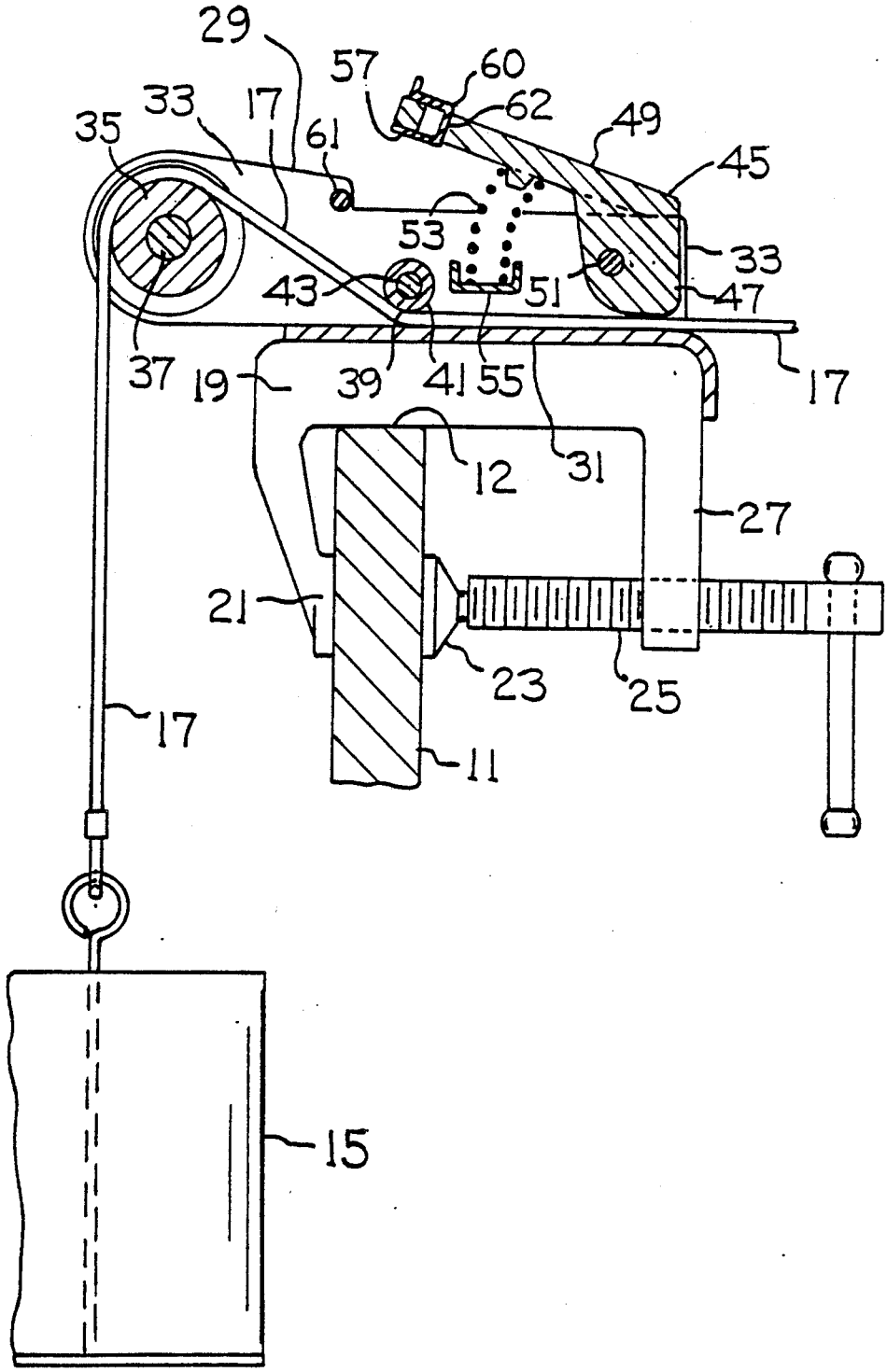
29
57
60
62
49
45
33
17
35
61
53
33
43
51
47
37
19
39
41
55
17
12
31
27
21
23
25
17
11
15

BOAT ANCHOR LINE CONTROL

BACKGROUND AND SUMMARY OF THE INVENTION

This invention relates to a mechanism for controlling the extension of a boat anchor line from a small boat, e.g. a small fishing boat having a length less than twenty five feet. The mechanism is designed to be detachable from the boat, whereby the mechanism can be used on any boat where it might be needed.

Persons owning two or more small boats sometimes encounter the problem of not having a boat anchor for one of the boats. Occasionally a boat anchor and line will be stolen from a boat. To meet these situations the present invention provides a detachable mechanism for operatively connecting a boat anchor and anchor line to a boat. The mechanism is detachable from any boat on which it is installed; the mechanism can therefore be used interchangeably on different boats, as the need may arise. Because of its detachable character the mechanism can be safely stored in any desired location away from the owner's boats, where the mechanism can be safeguarded against theft.

In a preferred form of the invention the mechanism includes a manually-operated line-gripper device for locking the line in any selected degree of extension from the boat, as might be necessary to anchor the boat in waters of different depths or to hold the boat different distances away from the submerged anchor. The mechanism is designed as a relatively low cost detachable device, so that it can be readily purchased by the average fisherman for use on small fishing boats.

THE DRAWINGS

The single figure is a sectional view taken through a device embodying the invention.

DESCRIPTION OF A PREFERRED EMBODIMENT OF THE INVENTION

The drawings fragmentarily show a boat transom 11 having an upper edge 12. The area to the right of the transom would constitute the interior space within the boat. The area to the left of wall 11 is outside the boat. An anchor 15 is attached to a flexible line (rope) 17 for downward movement into the water or upward movement out of the water. As shown in the drawing the anchor is in a suspended position located out of the water.

Line 17 is trained through a mechanism that controls the extension of the line from the boat. The mechanism comprises a c-shaped mounting member 19 positionable on the upper edge of boat wall 11. This mounting member comprises a stationary jaw 21 engageable against the outer surface of wall 11 and a movable jaw 23 engageable against the interior surface of wall 11. Jaw 23 has a swivel connection with a screw 25 that extends through a nut in arm portion 27 of member 19. The screw can be manually turned so that jaws 21 and 23 exert a squeezing force on wall 11 for releasably securing member 19 on the upper edge of wall 11.

An upstanding u-shaped trough structure 29 is secured to the web portion of member 19, as by welding. The trough structure comprises a horizontal web wall 31 and two parallel upstanding flange walls; one of the flange walls is designated by numeral 33 in the drawing.

A rotatable pulley 35 is movably mounted on a transverse pin 37 that extends between the flange walls of trough structure 29 at a point near the outboard (left) end of the trough structure. A cylindrical guide element 39 is located at approximately the midpoint along the length of the trough structure; the guide element can be a rotary sleeve 41 encircling a pin 43 that extends transversely between flange walls 33. Line 17 runs over pulley 35 and underneath guide element 39.

A spring -biased line gripper device 45 is swingably supported in trough structure 29 near its inboard (right) end. The line extends through gripper device into the boat with the excess length of the line coiled or piled within the boat. Line gripper device 45 includes a clamp element 47 attached to a manually-depressible handle 49. The clamp element is swingably mounted on a transverse pivot pin 51 that extends between the upstanding walls of the trough structure. A compression coil spring 53 is trained between handle 49 and a fixed abutment 55, whereby the line gripper device is resiliently biased in a clockwise direction around the axis of pin 51. The spring biases clamp element 47 to a position whereby the line is clamped against motion through the trough structure.

Handle 49 can be a flat pad element having a transverse width greater than the transverse dimension of the trough structure 29. When manual hand pressure is applied to the upper surface of handle 49 the handle can be depressed so that its underface engages the edges of walls 33; coincidentally clamp element 47 is release from line 17. The person can use one hand to depress handle 49 and the other hand to pull (or let slip) the line 17, for raising or lowering anchor 15.

Situations will arise where it is desirable for the person to use both hands for pulling or controlling the anchor line. A slidable latch 57 is movably mounted on handle 49 for extension beyond the free edge 59 of the handle; the latch includes a thumb actuator portion 60 and a connector portion 62 extending through a slot opening in handle 49. A rod-shaped detent 61 extends between flange walls 33 in the path of latch 57 (when handle 49 is in a depressed position).

When the handle is depressed to engage the upper edge of trough walls 33, latch 57 can be slidably extended to underlie detent 61, thereby retaining handle 49 in its depressed position. The person can therefore have both ends free to pull or otherwise control anchor line 17.

The mechanism represents a relatively low cost device for controlling the extension of a boat anchor line from the boat on which the device is installed. By turning screw 25 it is possible to detach the device from the boat for safe storage or use on another boat. The mechanism can be installed on the rear (transom) wall of a small fishing boat, or wherever convenient, e.g. at the bow of the boat. In its preferred form, the mechanism includes an elongated trough structure 29 that spans the associated boat wall, whereby pulley 35 is located outboard in a position wherein the anchor can be pulled vertically outwardly without striking the bottom surface of the boat.

The drawings show one particular embodiment of the invention. However, it will be appreciated that some variations and structural modifications can be used while still practicing the invention.

What is claimed is:

1. A mechanism for controlling the extension of a boat anchor line from a boat; said mechanism comprising a c-shaped mounting means having opposed jaws engageable against opposite surfaces of a boat wall to rigidly position the mounting means on the wall; a trough structure supported on said mounting means; a pulley rotatably supported in said trough structure at one end thereof; and a spring-biased line gripper device supported in said trough structure at its other end; said mechanism being adapted to have a boat anchor line pass through the line gripper device, around the pulley and downwardly into the water; said line gripper device having a line-engageable clamp element normally holding the line in a fixed condition relative to the trough structure, and a manually-operated handle for releasing said clamp element from the line.

2. The mechanism of claim 1, wherein said clamp element is swingably mounted on the trough structure for motion around a horizontal axis extending transversely across the trough structure.

3. The mechanism of claim 1, and further comprising a guide element located within the trough structure between the line gripper device and the pulley; said guide element being oriented so that the line runs from the line gripper device underneath the guide element and upwardly over the pulley.

4. The mechanism of claim 1, wherein said manually-operated handle is a depressible pad element located above the trough structure for downward arcuate motion to effectuate a line-release action.

5. The mechanism of claim 4, and further comprising a spring means located within the trough structure to exert an upward biasing force on the depressible pad element.

6. The mechanism of claim 4, and further comprising a manually-actuable latch means carried by said pad element for retaining said pad element in a depressed position

7. The mechanism of claim 1, wherein the clamp element and handle are swingable as a unit around a horizontal swing axis extending transverse to the path of the anchor line.

8. The mechanism of claim 7, wherein the handle is swingable downwardly onto the edges of the trough structure.

9. The mechanism of claim 8, and further comprising a slidable latch means carried by the handle for retaining said handle in a line-released position; and a detent element extending across the trough structure in the path of the slidable latch means.

* * * * *